US009419392B2

(12) United States Patent
Kirkpatrick et al.

(10) Patent No.: US 9,419,392 B2
(45) Date of Patent: Aug. 16, 2016

(54) AUTOMATIC IDENTIFICATION OF AN ADAPTER IN AN ON-BOARD DIAGNOSTIC SYSTEM

(71) Applicant: HTI IP, LLC, Arlington, VA (US)

(72) Inventors: Stephen Craig Kirkpatrick, San Diego, CA (US); Aaron Olaff Nevarez Pedroza, San Diego, CA (US); Alan Wettig, San Diego, CA (US); Bryant Elliott, Johns Creek, GA (US)

(73) Assignee: Verizon Telematics Inc., Atlanta, GA (US)

( * ) Notice: Subject to any disclaimer, the term of this patent is extended or adjusted under 35 U.S.C. 154(b) by 51 days.

(21) Appl. No.: 14/327,018

(22) Filed: Jul. 9, 2014

(65) Prior Publication Data

US 2016/0013598 A1 Jan. 14, 2016

(51) Int. Cl.

| | |
|---|---|
| ***H01R 24/68*** | (2011.01) |
| ***H01R 13/66*** | (2006.01) |
| ***G07C 7/00*** | (2006.01) |
| *H01R 107/00* | (2006.01) |

(52) U.S. Cl.

CPC *H01R 24/68* (2013.01); *G07C 7/00* (2013.01); *H01R 13/6683* (2013.01); *H01R 2107/00* (2013.01)

(58) Field of Classification Search

CPC ... H01R 13/447; H01R 13/60; H01R 13/6397
See application file for complete search history.

(56) References Cited

U.S. PATENT DOCUMENTS

| | | | | |
|---|---|---|---|---|
| 5,876,248 | A * | 3/1999 | Brunker | H01R 23/688 439/607.08 |
| 7,195,518 | B2 * | 3/2007 | Bert | H01R 4/2441 439/290 |
| 7,553,173 | B2 * | 6/2009 | Kowalick | H01R 13/443 439/133 |
| 7,727,028 | B1 * | 6/2010 | Zhang | H01R 12/716 439/108 |
| 2002/0055296 | A1 * | 5/2002 | Mochizuki | H01R 13/24 439/450 |
| 2003/0013325 | A1 * | 1/2003 | Zaderej | H01R 13/65807 439/74 |
| 2003/0176094 | A1 * | 9/2003 | Myer | H01R 13/41 439/246 |
| 2004/0192108 | A1 * | 9/2004 | Ward | H01R 13/4364 439/595 |
| 2008/0261462 | A1 * | 10/2008 | Mizumura | H01R 23/68 439/876 |
| 2009/0197464 | A1 * | 8/2009 | Hardy | H01R 31/065 439/559 |
| 2010/0105241 | A1 * | 4/2010 | Berkobin | H01R 13/5841 439/470 |
| 2012/0072048 | A1 * | 3/2012 | Gentner | H01R 13/70 701/1 |
| 2012/0258628 | A1 * | 10/2012 | Huang | B60R 16/0232 439/620.21 |

* cited by examiner

*Primary Examiner* — Truc Nguyen

(57) ABSTRACT

Adapters for OBD ports of a vehicle may include mechanisms for identifying the adapter (e.g., determine the manufacturer and/or type of the adapter) to an OBD device that is being used with the adapter. In one implementation, a male OBD connector of an OBD device may include a set of upper pins, a set of lower pins, and a middle portion, disposed between the set of upper pins and the set of lower pins, the middle portion including one or more pins. Identification logic, of the OBD device, may include a sensor connected to the one or more pins, to sense one or more values corresponding to a type of the compatible adapter.

20 Claims, 12 Drawing Sheets

AUTOMATIC IDENTIFICATION OF AN ADAPTER IN AN ON-BOARD DIAGNOSTIC SYSTEM

BACKGROUND

The term "On-Board Diagnostics" (OBD) refers to a computer-based monitoring system built into vehicles. For example, in the United States, model year 1996 and newer light-duty cars and trucks include an OBD system. The OBD system may monitor the performance of some of an engine's components.

In vehicles that include OBD systems, an OBD port may allow external devices ("OBD devices") to be connected to and communicate with the OBD systems. The OBD devices may receive power from the OBD port of the vehicle, thus allowing the devices to be mounted in a relatively permanent manner within the vehicle. Due to mounting requirements of different OBD devices and/or different physical locations of OBD ports in different vehicles, an adapter may be used. The adapter may include a male OBD interface that is designed to be inserted into the OBD port of the vehicle, and a female OBD interface into which the OBD device may be inserted.

DETAILED DESCRIPTION OF PREFERRED EMBODIMENTS

The following detailed description refers to the accompanying drawings. The same reference numbers in different drawings may identify the same or similar elements.

The term "on-board diagnostics" (OBD) will be used herein to refer to the self-diagnostic and reporting capabilities of vehicles. An "OBD system" or "OBD interface" may generally refer to a number of OBD interfaces and/or protocols, including an OBD-I, OBD-1.5, and/or OBD-II systems.

Adapters for OBD ports of a vehicle, as described herein, may include mechanisms for identifying the adapter (e.g., determine the manufacturer and/or type of the adapter) to an OBD device that is being used with the adapter. Knowing the type of the OBD adapter may be useful to the OBD device in a number of situations. For example, knowing the type of the OBD adapter may be helpful in identifying a vehicle or class of vehicle to which the adapter is connected (e.g., certain adapters may be used for particular vehicles or for particular applications) and/or identifying protocols used by the corresponding OBD system of the vehicle.

Figure 1:
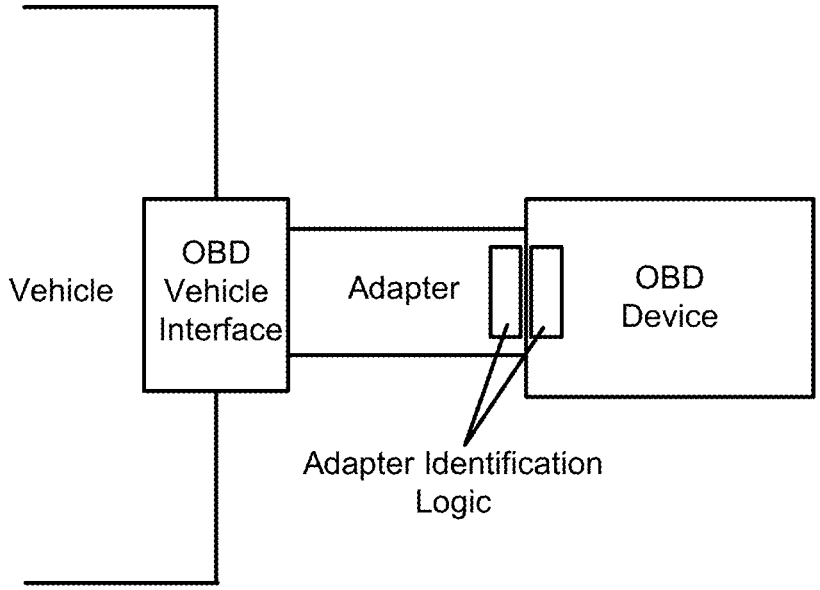
FIG. 1 is a diagram illustrating an example of an overview of concepts described herein.

FIG. 1 is a diagram illustrating an example of an overview of concepts described herein. As illustrated, a vehicle may include an OBD vehicle interface (a female OBD interface). The user of the vehicle may wish to connect an OBD device. The OBD device may include, for example, a telematics device that monitors driving habits of an owner of the vehicle (e.g., to obtain an insurance quote that reflects the actual driving habits of the owner) or provides diagnostic information to the owner of the vehicle. An adapter may be used to connect the OBD vehicle interface (i.e., the OBD port of the vehicle) to the OBD device.

As illustrated, the adapter and the OBD device may include logic (adapter identification logic) to allow the OBD device to identify the particular type of the adapter. For example, when the OBD device is inserted into the adapter, the OBD device may communicate with and/or sense the adapter to identify the type of the adapter.

It may be desirable that the adapter identification logic function transparently with respect to normal operation of the OBD device and with respect to other OBD devices that are not designed to identify the adapter. For instance, it may be desirable that the adapter identification logic does not interfere with normal operation of the OBD device and that the OBD device can be inserted directly into the OBD vehicle interface (i.e., the OBD device may be inserted into some vehicles without using an adapter) and still function normally.

An OBD connector may include a plastic slot, referred to as an OBD connector "tongue" herein, that is used to physically stabilize the physical interface between the male and female OBD connectors. In some implementations described herein, the tongue may include one or more conductive slots that provide out-of-band (relative to the normal conductive paths of the OBD interface) signaling between the adapter and the OBD device. The one or more conductive slots may use a relatively small area of the total tongue surface, thus allowing the tongue portion to continue to physically stabilize the interface.

In one implementation, the conductive slots in the tongue may be used to implement a resistive circuit, a capacitive circuit, a frequency oscillator circuit, or other circuitry that the OBD device may sense to determine the type of the adapter. For example, the conductive slots may include a resistor of a particular resistance. The value of the resistance may be varied for different adapter types.

Instead of including a conductive slot in the tongue portion, in some implementations, the tongue portion of the adapter may include a light emitting diode and/or an ultrasonic generator. The OBD device may correspondingly include a signal sensor. The OBD device may determine the type of the adapter based on sensing of the light (e.g., the frequency or intensity of the light) or of an ultrasonic signal.

Alternatively or additionally, the adapter may include a wireless transmission circuit. For example, the adapter and the OBD device may include low-energy Bluetooth circuits that communicate with one another to allow identification of the type of adapter.

Figure 2A:
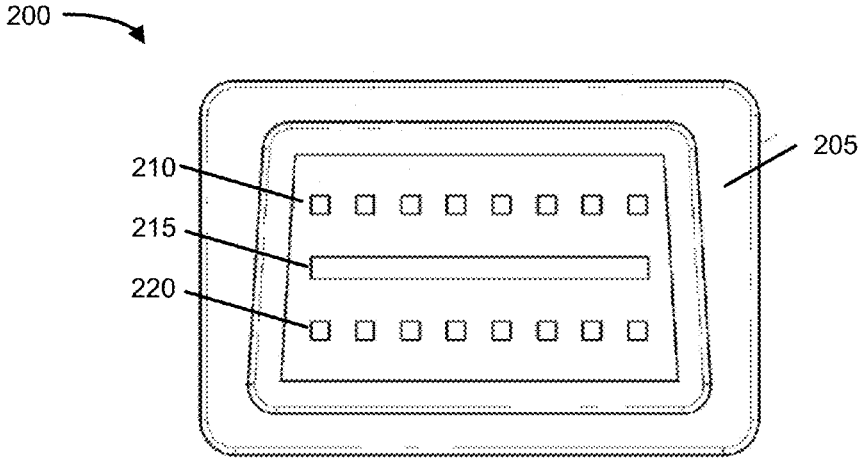
FIGS. 2A and 2B are diagrams illustrating examples of conventional male and female OBD connectors.
Figure 2B:
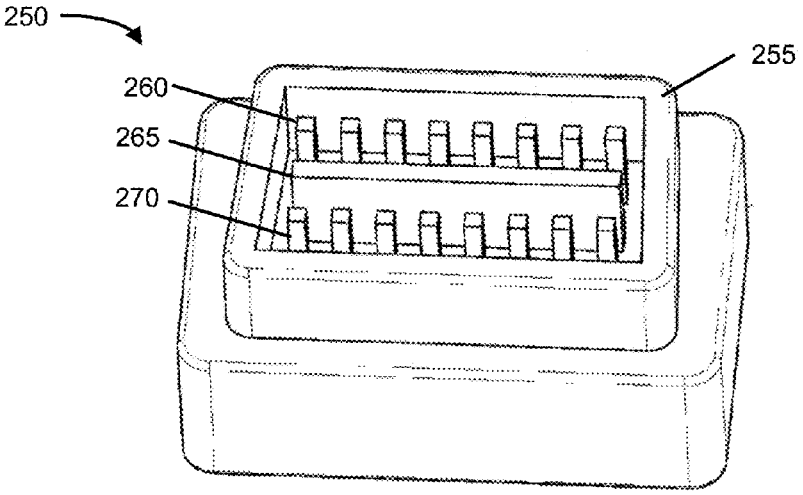

FIGS. 2A and 2B are diagrams illustrating examples of conventional male and female OBD connectors. FIG. 2A illustrates a female OBD-II connector (i.e., based on the SAE J1962 standard) and FIG. 2B illustrates an example of a corresponding male OBD-II connector.

Female OBD connector 200, as illustrated in FIG. 2A, provides a 16 pin (2×8) connector. Female OBD connector 200 may be mounted within a vehicle, such as underneath the steering wheel, etc. Female OBD connector 200 may include an outer mount 205, eight upper pin slots 210, a middle slot 215, and eight lower pin slots 220. Outer mount 205 may include a physical (e.g., plastic) housing for OBD connector 200. Middle slot 215 may include a space or groove into which a corresponding tongue, from the male OBD connector, can be inserted, to provide physical stability for the OBD interface. Upper pin slots 210 and lower pin slots 220 may include receptacles for electrical pins associated with the male OBD connector. Under the OBD-II standard, some of the electrical contacts (i.e., corresponding to upper pin slots 210 and lower pin slots 220) are specified as having specific purposes (e.g., chassis ground, signal ground) while other ones of the electrical contacts are left to the discretion of the manufacturer of the vehicle.

Male OBD connector 250, as illustrated in FIG. 2B, provides a connector that is designed to be inserted into female OBD connector 200. OBD connector 250 may include an outer mount 255, eight upper pins 260, tongue 265, and eight lower pins 270. Outer mount 255 may include a physical (e.g., plastic) housing for OBD connector 250. Tongue 265 may include a physical piece (e.g. a rectangular piece of plastic or other material) that can be inserted into middle slot 215 of female OBD connector 200. Upper pins 260 and lower pins 270 may include electrical contacts designed to be inserted into upper pin slots 210 and lower pin slots 220, respectively. Although sixteen pins (eight for upper pins 260 and eight for lower pins 270) are illustrated, in various situations, some of pins 260 and/or 270 may not be used and may thus be omitted.

Figure 3A:
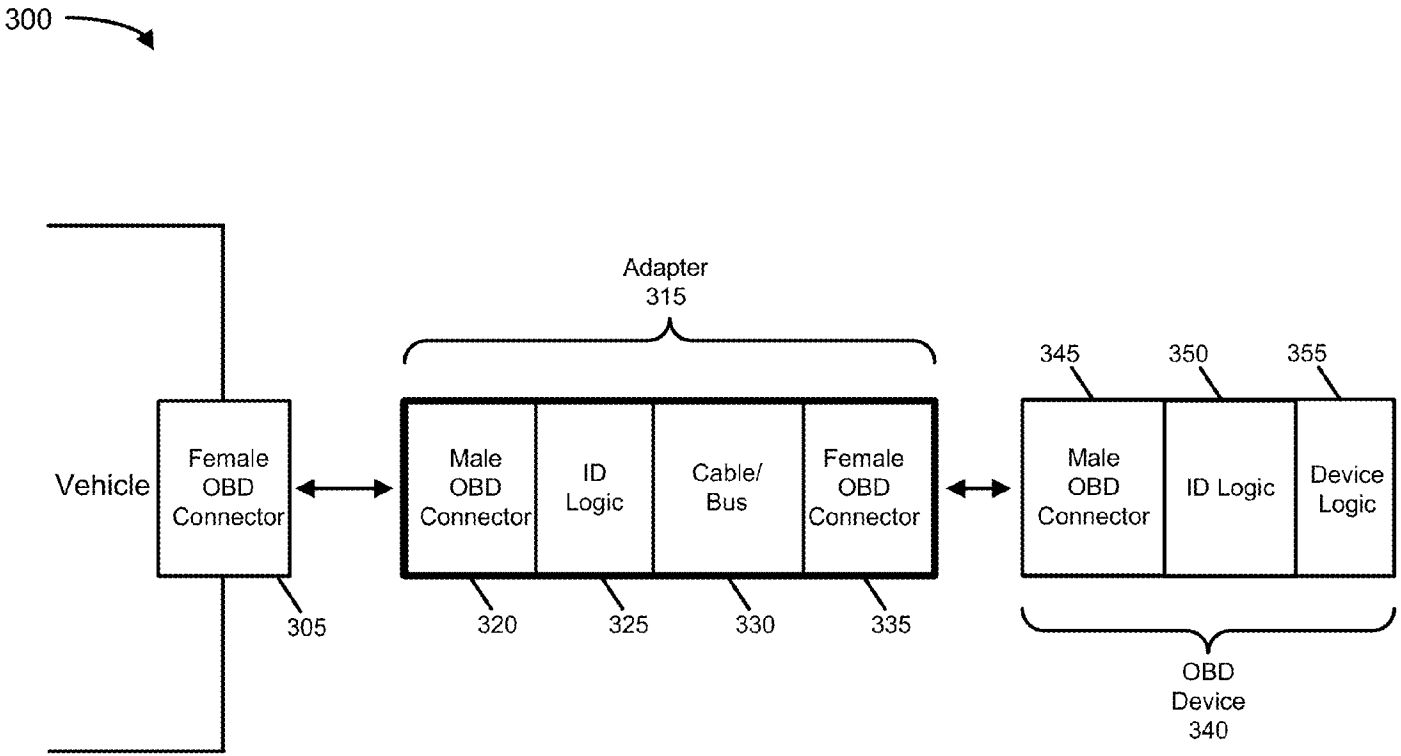
FIG. 3A is a diagram illustrating an example functional block diagram of techniques described herein.

FIG. 3A is a diagram illustrating an example functional block diagram of techniques described herein. In FIG. 3A, environment 300 may generally represent an environment in which an OBD device is inserted into a vehicle using an adapter. As shown in FIG. 3A, environment 300 may include female OBD connector 305, adapter 315, and OBD device 340. Female OBD connector 305 may include an OBD connector, such as female OBD connector 200, mounted within a vehicle.

Adapter 315 may include an adapter or harness designed to provide an interface between female OBD connector 305 and OBD device 340. Adapter 315 may include, for example, an adapter that provides a secure mounting point for OBD device 340 within one or more makes/models of vehicles. As an example, adapter 315 may include a Y-harness type adapter that includes multiple (e.g., two) connections for OBD devices 340 (i.e., two OBD devices 340 may be logically connected to the OBD port of the vehicle). Adapter 315 may include male OBD connector 320, identification (ID) logic 325, cable/bus 330, and female OBD connector 335.

Male OBD connector 320 may include an OBD connector, such as male OBD connector 250 (FIG. 2B), that is designed to be inserted into female OBD connector 305. Cable/bus 330 may include cables and/or a printed circuit board (PCB) with conductive traces that provide an electrical connection between OBD male connector 320 and female OBD connector 335.

In other possible implementations, female connector 305 and male connector 320 may include interfaces other than OBD interfaces. For example, in some vehicles, such as heavy trucks, diagnostic interfaces other than OBD interfaces may be implemented (e.g., an SAE J1939 standard connection or a J1708 standard connection). In this case, female connector 305 and male connector 320 may instead be implemented as to provide an interface for the alternate standard connection. A J1939 connection may include a 9-pin connection and the J1708 connection may include a 6-pin connection. In another possible implementation, for vehicles that do not include an OBD connection, male connector 320 of adapter 315 may include a number of wires or cables (e.g., a three-wire cable).

Identification logic 325 may include one or more components that identify adapter 315 to OBD device 340. Identification logic 325 may include a resistor of a particular value, a capacitor of a certain value, oscillators, radio frequency components, or other elements. Identification logic 325 may operate with identification logic 350 (of OBD device 340) to allow OBD device 340 to identify adapter 315. Example implementations of identification logic 325 will be described in more detail below.

Figure 3B:
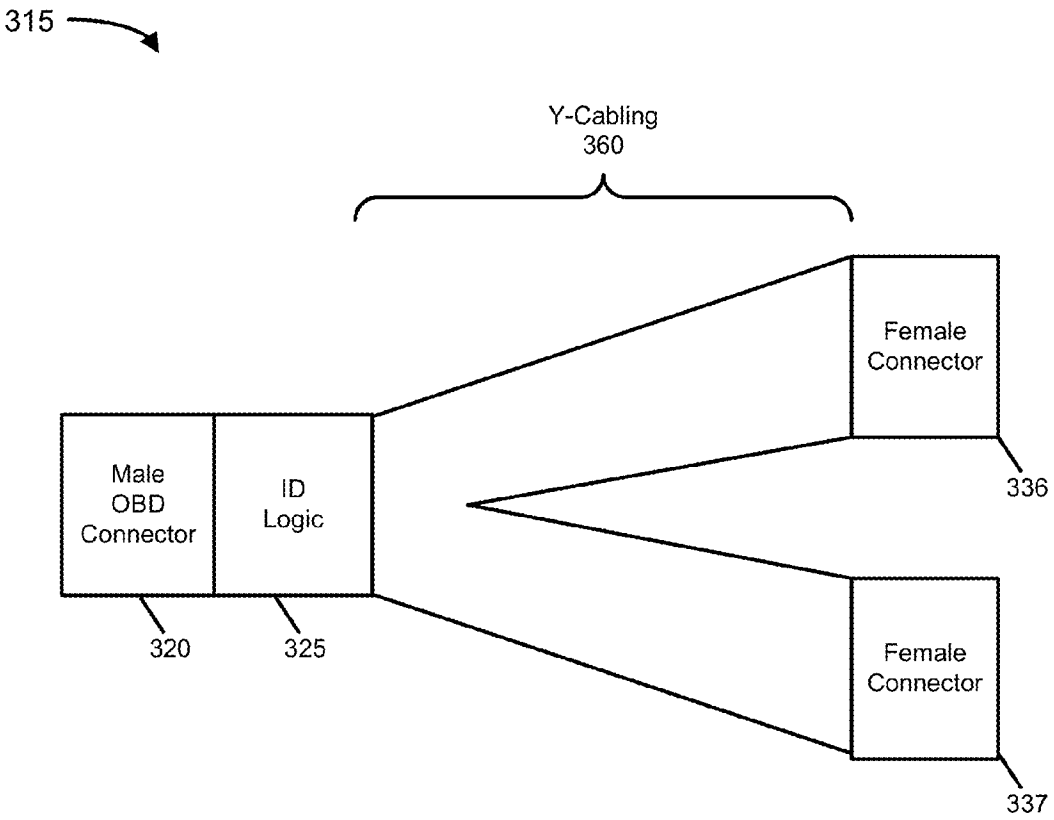
FIG. 3B is a diagram illustrating an implementation of the adapter, shown in FIG. 3A, in which the adapter includes a Y-harness.

Cable/bus 330 may include circuitry and/or wiring to connect identification logic 325 and/or male OBD connector 320 to female OBD connector 335. In one implementation, cable/bus 330 may represent circuit traces or connections that directly connect identification logic 325 and/or male OBD connector 320 to female OBD connector 335. In another possible implementation, cable/bus 330 may include a physical length of cable or wires (e.g., a foot long length of cable) that may provide flexibility in installing OBD device 340 inside the vehicle. In another possible implementation, and as illustrated in FIG. 3B, cable/bus 330 may include a Y-harness that connects to multiple female OBD connectors 335. ID logic 325 may reside within, or result from connections at, one or more of connector 320 or connectors 335. For example, conductors of Y-harness cabling 360 may be connected to pins at one, or more, of the connectors 320 and 335 in a particular way so that certain of the conductors are connected to ground, either directly, or through resistors or other electrical component or components when connector 320 has been plugged into a vehicle diagnostic port. A given combination of conductors that are connected and not connected to ground may cause OBD device 340, as shown in FIG. 3A, to identify the particular Y-harness 360 and connectors 320/335 combination, it may be coupled to, and to use information stored on it to determine, based on the detected Y-harness/connectors combination it is coupled to, a particular vehicle diagnostic protocol that corresponds to the detected y-harness. Thus, based on determining a particular Y-harness 360, OBD device 340 can configure itself to operate properly with the vehicle protocol that corresponds to the detected y-harness. It will be appreciated that the term Y-harness may be used to refer to cabling 360, and also to a combination of cabling 360, connector 320, and connectors 335. A female OBD connector 335 may include an OBD connector that provides compatibility with conventional male OBD connectors, such as OBD connector 250, and that may additionally include one or more pin slots that are not associated with a standard OBD connector. In one implementation, female OBD connector 335 may include one or more pin slots that are provided in an area corresponding to the middle slot (e.g., middle slot 215 in FIG. 2A) in a standard female OBD connector.

FIG. 3B is a diagram illustrating an implementation of adapter 315 in which the adapter includes a Y-harness, or in which a Y-harness includes, or essentially functions as, the adapter. As illustrated, adapter 315 may include male OBD connector 320 and identification logic 325. In this implementation, cable/bus 330 may include Y-cabling 360. Y-cabling 360 may include a cable or set of wires that is split to include two end connections, each of which may be terminated with female connectors 336 and 337. Y-cabling 360 may be useful to, for example, allow an operator to use an OBD device 340, such as a telematics device, while still providing an OBD port that can be used for other OBD operations, such as an open OBD port that may be used during vehicle diagnostics at a service station. Female connectors 336 and 337 may include female OBD connectors, such as female OBD connector 335, or female connectors associated with other types of connections (e.g., a J1939 connection). In one implementation, female connectors 336 and 337 may include different types of connectors. For example, female connector 336 may include an OBD connector and female connector 337 may include a J1939 connector.

In one implementation, male OBD connector 320 and identification logic 325 may be distributed as an interchangeable component that is connected to Y-cabling 360 and female OBD connector 335. For example, adapter 315 may be sold and/or manufactured such that male OBD connector 320 and identification logic 325 may be varied depending on the target vehicle. For example, a heavy vehicle (e.g., a truck), instead of including an OBD port, may include a J1939 diagnostic connection. In this case, male connector 320 and female connector 336 may include a corresponding J1939 connection (i.e., a 9-pin connector) and identification logic 325 may include circuitry to identify the J1939 connection. In this case, the other female connector, connector 337, may be a connector designed to be compatible with an OBD telematics device (e.g., a standard 16-pin OBD-II connector). An end-user may purchase male OBD connector 320 and identification logic 325 as a single component, appropriate for the type of vehicle of the end-user, that may be inserted into Y-cabling 360 and female OBD connector 335.

Figure 4A:
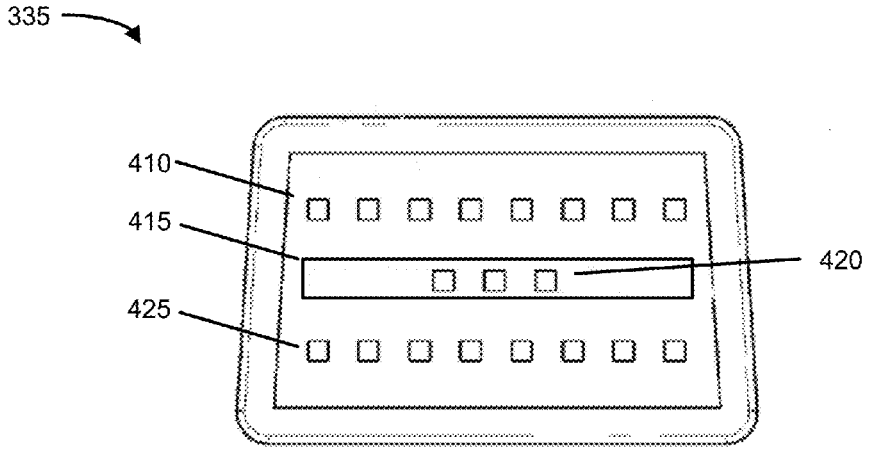
FIGS. 4A and 4B are diagrams illustrating examples of female OBD connectors and male OBD connectors, respectively, consistent with aspects described herein.

One example of an implementation of female OBD connector 335 is illustrated in FIG. 4A. As illustrated, female OBD connector 335 may include eight upper pin slots 410, middle slot 415, middle pin slots 420, and lower pin slots 425. Middle slot 415 may include a space or groove into which a corresponding tongue, from a male OBD connector, can be inserted, to provide physical stability for the OBD interface. Upper pin slots 410 and lower pin slots 420 may include receptacles for electrical pins associated with the standard pins of a male OBD connector.

Consistent with aspects described herein, middle pin slots 420 may be included within middle slot 415. Middle pin slots 420 may be implemented in a manner that does not interfere a with space or groove, corresponding to middle slot 415, in providing physical stability for the OBD interface. Three example pin slots are shown as corresponding to middle pin slots 420. In other implementations, fewer pin slots (e.g., two or one) or more pin slots may be implemented as part of middle pin slots 420.

Referring back to FIG. 3, OBD device 340 may include a telematics device that monitors driving habits of an owner of the vehicle, a device that provides diagnostic information to the owner of the vehicle, or another device designed to communicate with the OBD system of a vehicle. OBD device 340 may include male OBD connector 345, identification logic 350, and device logic 355.

Male OBD connector 345 may include an OBD connector that provides compatibility with conventional female OBD connectors, such as female OBD connector 200, but that may also include one or more pins that are not associated with a standard OBD connector. Male OBD connector 345 may be designed to be inserted into female OBD connector 335 such that the middle pin slots (e.g., middle pin slots 420) of female OBD connector 335 may be engaged (e.g., electrically connected).

Figure 4B:
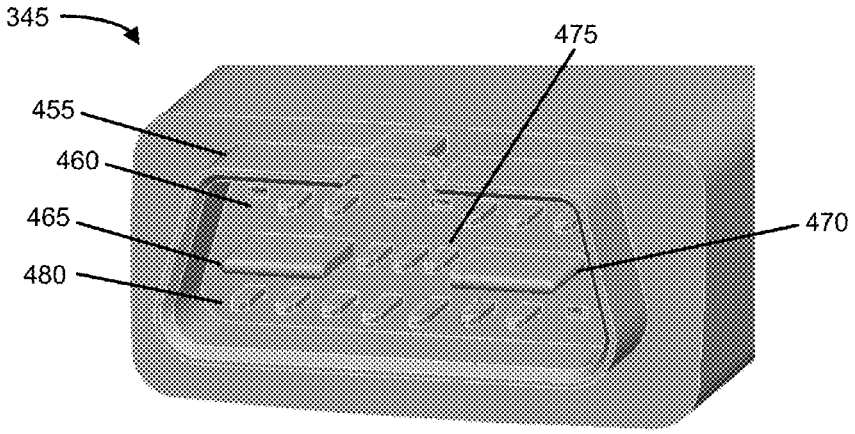

One example of an implementation of male OBD connector 345 is illustrated in FIG. 4B. As illustrated, male OBD connector 345 may include housing 455, upper pins 460, tongue portion 465, tongue portion 470, middle pins 475, and lower pins 480. Housing may include, for example, a plastic or metal housing. Upper pins 460 and lower pins 480 may include electrical contacts designed to be inserted into upper pin slots 410 and lower pin slots 425, respectively, of female OBD connector 335 The electrical contacts provided by upper pins 460 and lower pins 480 may provide signaling and/or power lines consistent with an OBD system. In an implementation corresponding to an OBD-II system, upper pins 460 may implement pins 9-16 of the OBD-II standard and lower pins 480 may implement pins 9-16 of the OBD-II standard.

As illustrated, not all of the possible eight upper and eight lower pins, of a standard OBD connector, may be used. For example, upper pins 460 may include five pins (e.g., from left to right, pins one, four, and five may not be used) and lower pins 480 may include seven pins (e.g., from left to right, pin eight may not be used). In other implementations, some or all of the OBD standard pins may be used.

Consistent with aspects described herein, the tongue of male OBD connector 345 may include a gap, illustrated in FIG. 4B as a gap between tongue portion 465 and tongue portion 470. Middle pins 475 may be placed within the gap. Although three middle pins 475 are particularly illustrated in FIG. 4B, in other implementations, fewer (e.g., one or two pins) or more pins may be implemented. Tongue portions 465 and 470 may include, for example, a plastic material (or another material) that provides physical stability when inserted into middle slot 415. In one implementation, tongue portions 465 and 470 may each cover approximately a third of the middle portion between upper pins 460 and lower pins 480 (middle pins 475 may cover the other third). Middle pins 475 may be extend from the base of male OBD connector 345 to a height that is less than the height of tongue portions 465 and 470. In this manner, when inserted into a conventional female OBD connector (e.g., female OBD connector 200), middle pins 475 may be inserted into middle slot 215 and will not make contact with the conventional female OBD connector.

Although a gap is illustrated in FIG. 4B as between tongue portions 465 and 470, in other implementations, the gap (in which pins 475 are located) may be placed on the right or left side of the tongue. In this case, tongue portions 465 and 470 may be implemented as a single tongue.

Referring back to FIG. 3, OBD device 340 may additionally include identification (ID) logic 350 and device logic 355. Identification logic 350 may include one or more components that operate, with respect to identification logic 325 of adapter 315, to identify adapter 315. Identification logic 350 may include, for example, a resistance sensor, a capacitance sensor, a frequency sensor, or other elements. Example implementations of identification logic 350 will be described in more detail below.

Device logic 355 may include one or more computing and/or communication devices that act to implement the substantive operations of OBD device 340. Device logic 355 may, for example, implement a telematics device that monitors driving habits of an owner of the vehicle, provides diagnostic information to the owner of the vehicle, calls for emergency assistance (e.g., via a cellular network connection) when a vehicle crash is detected, or perform other functions. Device logic 355 may communicate with and/or monitor an OBD system of the vehicle.

FIGS. 5-8 are diagrams conceptually illustrating various implementations of identification logic 325 and identification logic 350. FIGS. 5-8 may generally illustrate various techniques by which OBD device 340 may identify adapter 315. In FIGS. 5-8, components associated with adapter 315 (e.g, identifier logic 325 and/or female OBD connector 305) may be illustrated on the left side of the figure and components associated with OBD device 340 (e.g., male OBD connector 345 and/or identification logic 350) may be illustrated on the right side of the figure.

Figure 5:
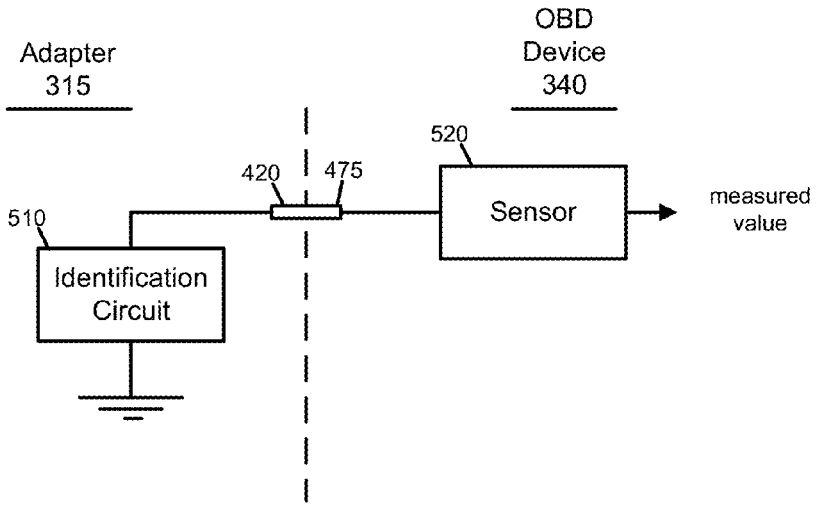
FIGS. 5, 6, 7, 8, 9A, and 9B are diagrams conceptually illustrating various implementations of identification logic used in the environment of FIG. 3.

As illustrated in FIG. 5, adapter 315 (e.g., identification logic 325 of adapter 315) may include identification circuit 510, and OBD device 340 (e.g., identification logic 350 of OBD device 340) may include sensor 520. Identification circuit 510 may include one or more passive or active circuit elements. Sensor 520 may include logic to measure a value relating to identification circuit 510. When adapter 315 is inserted into OBD device 340, identification circuit 510 and sensor 520 may be connected via the mating of middle slot pins 420 and middle pins 475. Sensor 520 may measure the value associated with identification circuit 510. The measured value may be transmitted to, for example, device logic 355 of OBD device 340.

Values for the circuit elements of identification circuit 510 may be set on a per-type of adapter basis. That different adapter types may be manufactured to include different values for the circuit elements. In one implementation, identification circuit 510 may include a resistor. For example, all adapters of a first type may be manufactured to include a 1 k-ohm resistor, all adapters of a second type may be manufactured to include a 2 k-ohm resistor etc. In this case, sensor 520 may measure the value of the resistor to identify the type of adapter. In another implementation, identification circuit 510 may include a capacitor. In this case, sensor 520 may measure the value of the capacitor to identify the type of adapter. In yet another implementation, identification circuit 510 may include a combination of a resistor and a capacitor (e.g., a resistive-capacitive (RC) circuit), or another combination of elements. In yet another possible implementation, identification circuit 510 may include an oscillator. In this case, sensor 520 may measure a frequency of the oscillator to identify the type of adapter.

Figure 6:
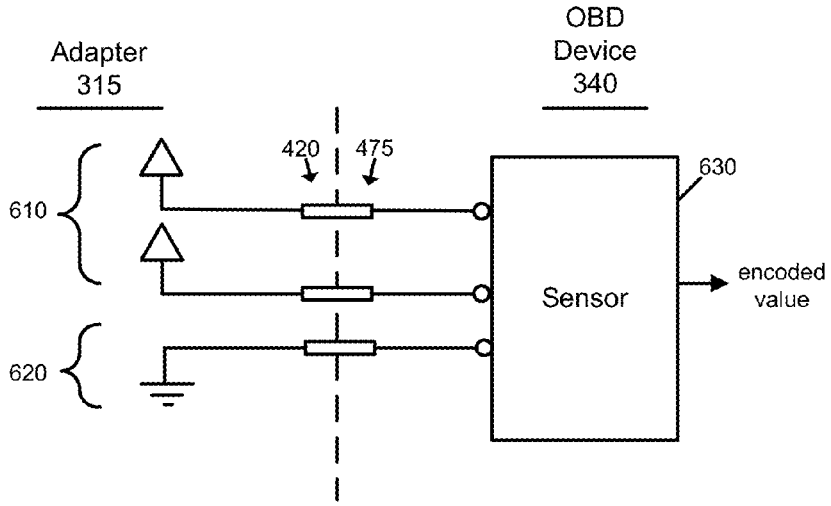

FIG. 6 is a diagram illustrating an example implementation of identification logic 325 and identification logic 350, associated with adapter 315 and OBD device 340, respectively, in which adapter 315 may be identified based on using middle slot pins 420 and middle pins 475 to encode a binary value. In the illustrated example, three middle slot pins 420 and three corresponding middle pins 475 (illustrated as being connected to form an electrical connection) are illustrated, in which two upper two pins/slots 610 are connected to a voltage source (illustrated by triangles) and lower pin/slot 620 is connected to ground. Sensor 630 may detect whether each pin is connected to supply voltage (e.g., a logic one) or to ground (e.g., a logic zero) and may interpret the corresponding sequence of logic ones and logic zeroes as an integer. For example, as illustrated, the three pins may be sensed, by sensor 630, as having the values logic one, logic one, and logic zero (e.g., binary 110), which may be interpreted as the encoded value of six (i.e., binary 110 equals six). Different adapter types may thus be manufactured to include different encoded values.

In FIG. 6, three pins/slots are illustrated as being used to encode a value associated with a type of adapter. In other implementations, more or fewer pins/slots could be used. Using additional pins/slots may allow for a greater number of distinct encoded values.

Figure 7:
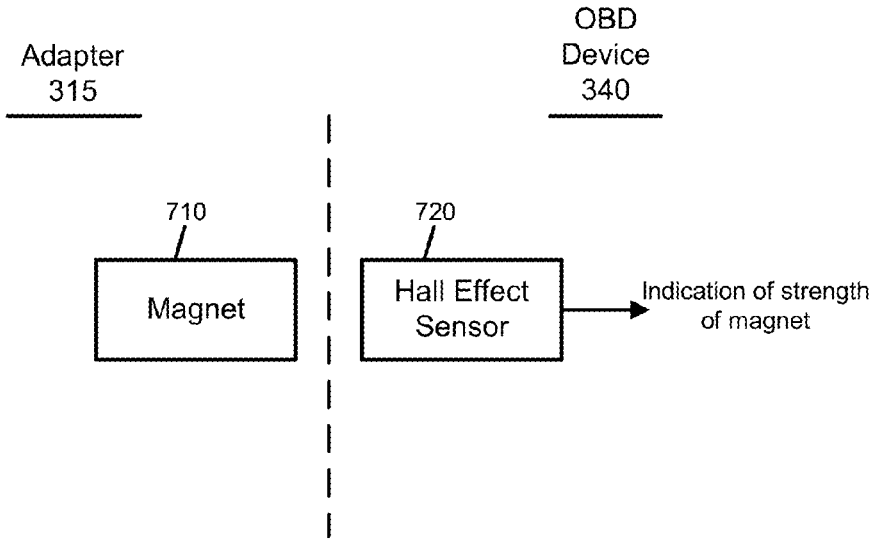

FIG. 7 is a diagram illustrating an example implementation of identification logic 325 and identification logic 350, associated with adapter 315 and OBD device 340, respectively, in which adapter 315 may be identified based on magnet 710 and Hall effect sensor 720. A Hall effect sensor may be a transducer that varies its output voltage in response to a magnetic field. Magnet 710 may be installed in a position associated with a middle pin slot 420 and Hall effect sensor 720 may be installed in a position associated with a middle pin 475. Magnet 710 and Hall effect sensor 720 may operate on the basis of proximity with one another. Accordingly, physical contact between magnet 710 and Hall effect sensor 720 may not be necessary.

Hall effect sensor 720 may detect when magnet 710 is in proximity to Hall effect sensor, such as by outputting a voltage proportional to the strength of the magnetic field associated with Hall effect sensor. The detected strength of magnet 710 may be used to identify adapter 315. For example, different adapters may manufactured to include different strength magnets 710. Alternatively, magnet 710 may be electrically controlled to turn on and off at different intervals. Magnet 710 may be varied at different frequencies for different adapters. Alternatively or additionally, multiple magnets 710 and corresponding Hall effect sensors 720 may be used to encode a value, such as with respect to the implementation illustrated in FIG. 6. In this situation, an encoded value may be sensed by OBD device 340 without requiring electrical contacts between adapter 315 and OBD device 340.

Figure 8:
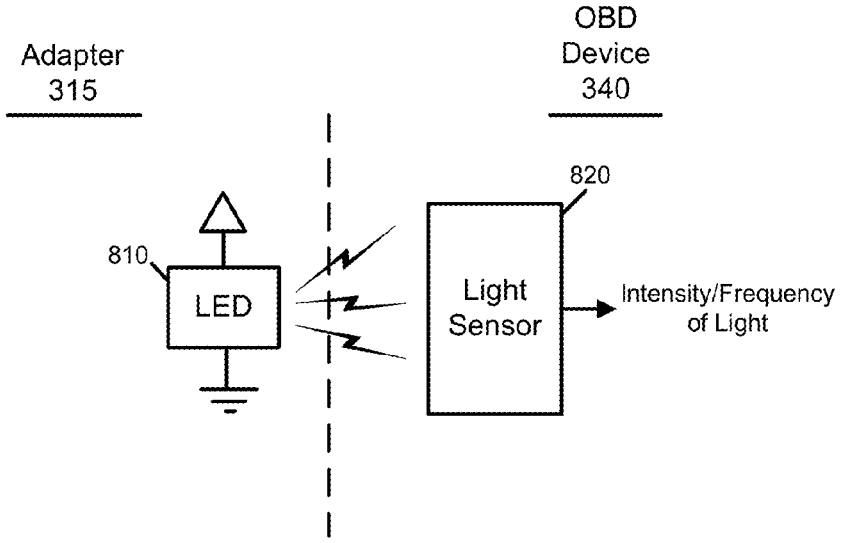

FIG. 8 is a diagram illustrating an example implementation of identification logic 325 and identification logic 350, associated with adapter 315 and OBD device 340, respectively, in which adapter 315 may be identified based on light sensed by a light sensor included as part of identification logic 350. A light emitting diode (LED) 810 may be installed in a position associated with a middle pin slot 420 and a light sensor 820 may be installed in a position associated with a middle pin 475. When adapter 315 is engaged with female OBD connector 305, power from female OBD connector 305 may be used to turn on LED 810, which may be sensed by light sensor 820. Light sensor 820 may output a voltage proportional to the intensity or frequency of the detected light. The detected intensity/frequency of the light may be used to identify adapter 315. For example, different adapters may manufactured to include LEDs 810 with different intensity or frequency characteristics. Alternatively or additionally, multiple LEDs and corresponding light sensors 820 may be used to encode a value, such as with respect to the implementation illustrated in FIG. 6. In this situation, an encoded value may be sensed by OBD device 340 without requiring electrical contacts between adapter 315 and OBD device 340.

In another possible implementation, LED 810 and light sensor 820 may both be implemented within OBD device 340. Adapter 315 may include reflective material designed to reflect the light output from LED 810 back to sensor 820. The intensity of the reflected light may be used to determine the type of adapter 315. Similarly, instead of using an LED and a light sensor, other generator/sensor combinations may be used, such as an ultrasonic generator and sensor.

In another possible implementation of identification logic 325 and identification logic 350, identification logic 330 and identification logic 350 may include corresponding radio frequency communication logic. For example, adapter 315 may include a radio frequency identification (RFID) tag and OBD device 340 may include a corresponding RFID sensor. As another example, adapter 315 and OBD device 340 may include Bluetooth Low Power (BLTE) devices that may communicate with one another.

Figure 9A:
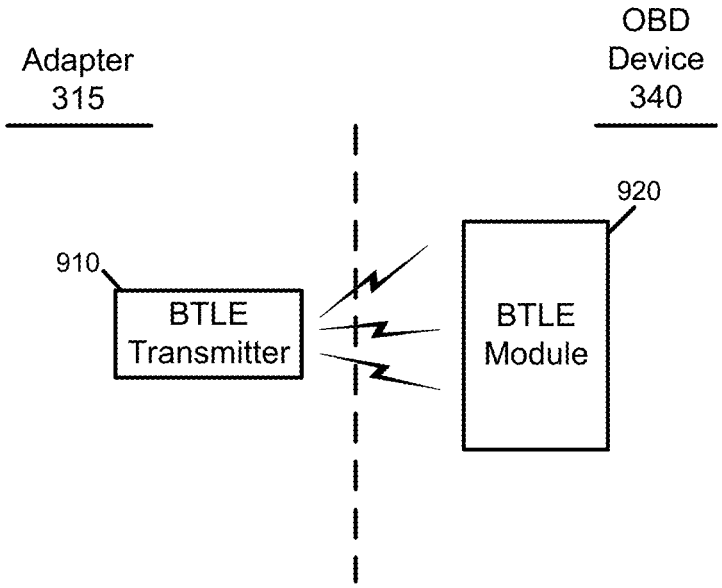

FIG. 9A is a diagram illustrating an example implementation of identification logic 325 and identification logic 350, associated with adapter 315 and OBD device 340, respectively, in which adapter 315 may be identified based on BLTE communications. As illustrated, adapter 315 may include a BTLE transmitter 910 and OBD device 340 may include a BTLE module 920. BTLE transmitter 910 may include a beacon that functions to periodically transmit an identification signal to nearby BTLE devices (e.g., BTLE module 920). In one implementation, BTLE transmitter 910 may transmit beacon signals whenever adapter 315 is inserted into female OBD connector 305 (and power is being provided from the vehicle). BTLE module 920 may sense when BTLE beacon is in proximity to BTLE beacon 910 and may determine an identifier value associated with the BTLE beacon. The identifier value may identify the type of adapter 315.

Figure 9B:
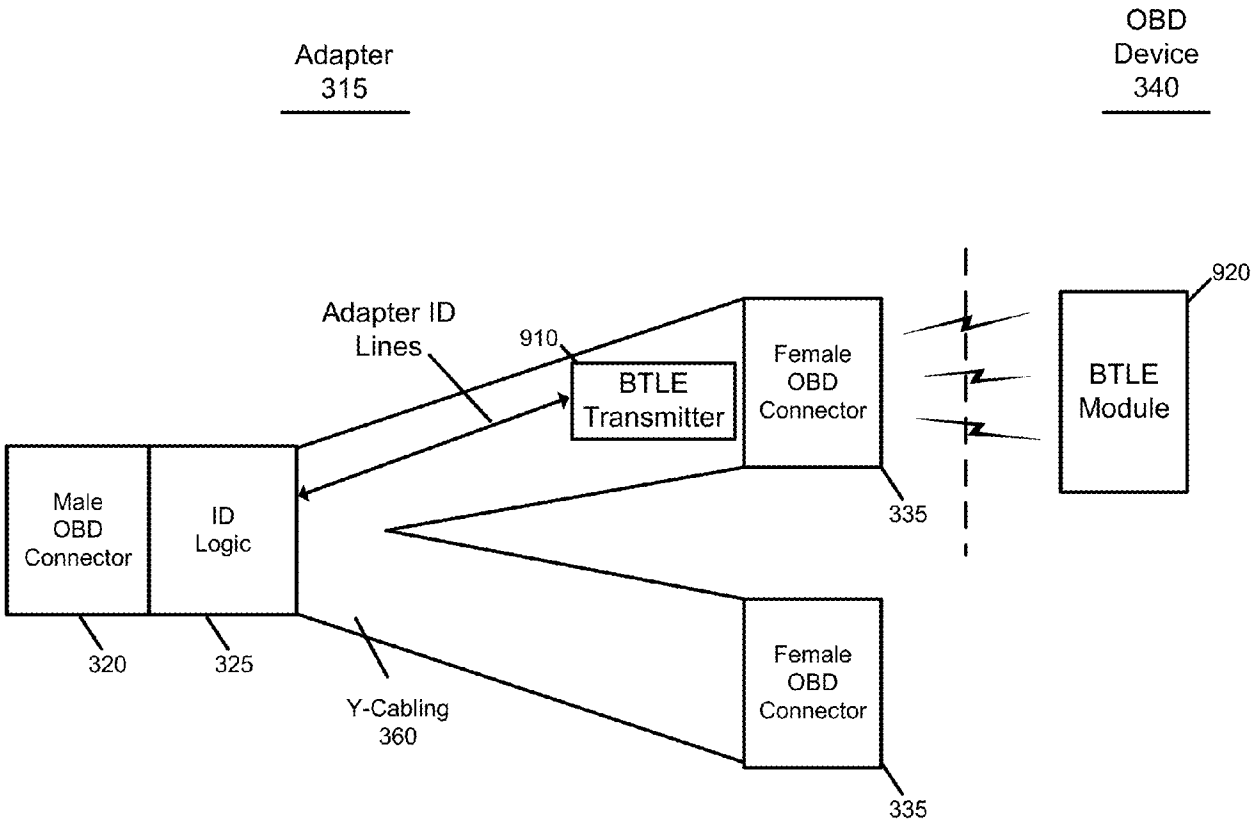

FIG. 9B is a diagram illustrating another example implementation of identification logic 330 and identification logic 350, associated with adapter 315 and OBD device 340, respectively. The implementation of FIG. 9B particularly illustrates an example in which BTLE transmitter 910 is used with Y-cabling, such as Y-cabling 360. As shown, BTLE transmitter 910 may be installed near an end of one of the terminations of Y-cabling 360. Y-cabling 360 may include one or more wires ("Adapter ID Lines") that connect to, or make up, identification logic 325. Based on a state of the Adapter ID Lines, BTLE transmitter 910 may determine a Y-harness identifier corresponding to the type of adapter 315 (or Y-harness that includes connector 320 and connectors 335) and hence the identification information to wirelessly transmit. For example, identification logic 325 may include circuitry similar to identification circuit 510 (FIG. 5) or the identification pins shown in FIG. 6. In general, one or more of the adapter/Y-harness implementations shown in FIGS. 5-8 may also be implemented in a device that uses Y-cabling 360, by electrically connecting the substantive identification logic (i.e., identification logic 325) with the Y-cabling. In another possible implementation, identification logic 325 may be implemented as part of Y-cabling 360 (e.g., such as part of BTLE transmitter 910 or in proximity to BTLE transmitter 910). In this case, identification of the adapter, using identification logic 325, may correspond to identification of the Y-cabling.

Figure 10A:
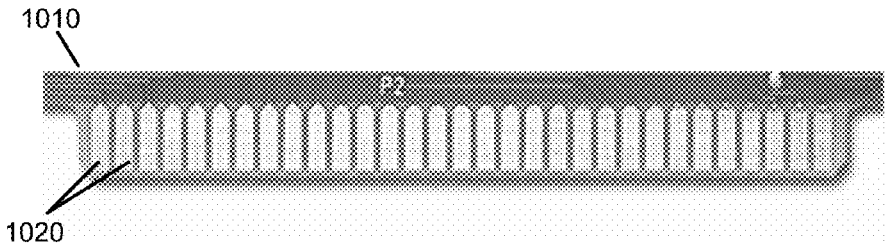
FIGS. 10A and 10B are diagrams illustrating a male and female OBD connectors, respectively, according to a second embodiment.
Figure 10B:
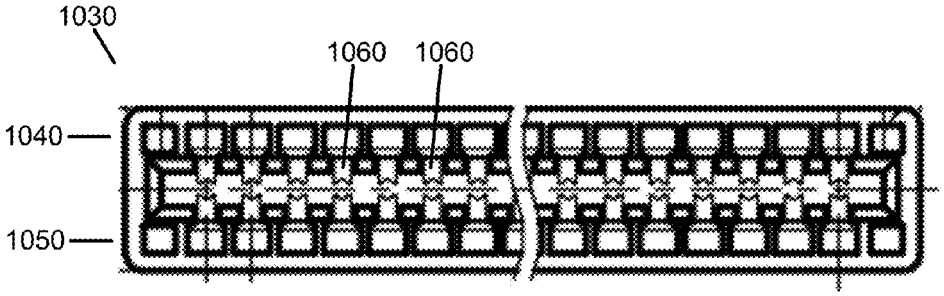

FIGS. 10A and 10B are diagrams illustrating a male and female OBD connectors, respectively, according to a second embodiment. FIG. 10A particularly illustrates electrical connections on the tongue of a male OBD connector (e.g., of male OBD connector 345). As illustrated, tongue 1010 may include a single supporting piece, such as tongue 265 (FIG. 2), but may additionally include electrical contacts 1020 on one or both sides of tongue 1010. FIG. 10B illustrates a female connector 1030 corresponding to the male OBD connector of FIG. 10A. Female OBD connector 1030 may thus be designed to mate with a male OBD connector that includes a tongue similar to tongue 1010.

Female OBD connector 1030 may include upper and lower pin slots 1040 and 1050. Additionally, one or more of pin slots 1040 and 1050 may include connectors 1060 designed to make physical contact with electrical contacts 1020 (when the male and female OBD connectors are mated with one another). Connectors 1060 may be spring mounted connectors that extend at a right angle relative to the insertion direction of pin slots 1040 and 1050. Thus, tongue 1010, when inserted into female OBD connector 1030, may "push" on the spring-mounted connectors to establish electrical connections.

Figure 11:
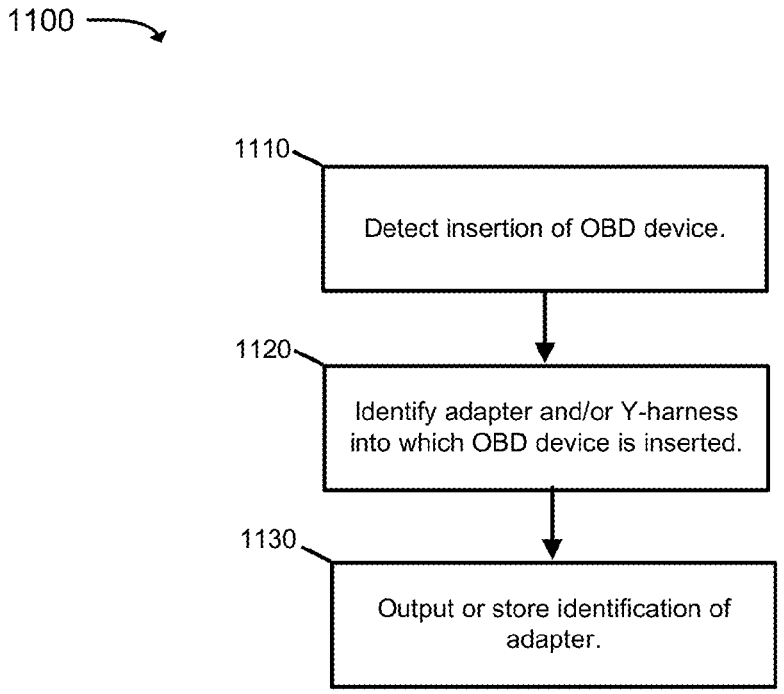
FIG. 11 is a flowchart illustrating an example process relating to identification of an adapter by an OBD device.

FIG. 11 is a flowchart illustrating an example process 1100 relating to identification of an adapter by an OBD device. Process 1100 may be performed by, for example, OBD device 340.

Process 1100 may include detecting insertion of the OBD device (block 1110). In one implementation, OBD device 340 may obtain electrical power from the vehicle. Inserting OBD device 340 into female OBD connector 335 may cause an initial power-up OBD device 340. As part of the initialization process, OBD device 340 may attempt to identify adapter 315.

Process 1100 may include identifying the adapter and/or Y-harness (e.g., based on identification logic 325) into which the OBD device is inserted (block 1120). The identification of adapter 315 may be performed using any of the techniques discussed above (e.g., with respect to the discussion of FIGS. 5-9). As previously mentioned, identification logic 325 may be implemented as part of a single adapter 315, in which case block 1120 may correspond to identifying the adapter. Alternatively, identification logic 325 may be included within Y-cabling 360, in which case block 1120 may correspond to identifying the type of Y-cabling. In this situation, Y-cabling 360 may implement, or function as, or in place of, adapter 315.

In situations in which OBD device 340 is inserted into a standard female OBD connector, such as female OBD connector 200, OBD device 340 may determine that the adapter is "unknown" or "standard".

Process 1100 may include outputting or storing the identification of the adapter (block 1130). In one implementation, OBD device 340 may store the identification of the adapter and use the identification as part of normal processing relating to OBD device 340. For example, knowing the type of the OBD adapter may be helpful in identifying a vehicle or class of vehicle to which the adapter is connected and/or identifying protocols used by the corresponding OBD system of the vehicle.

Figure 12:
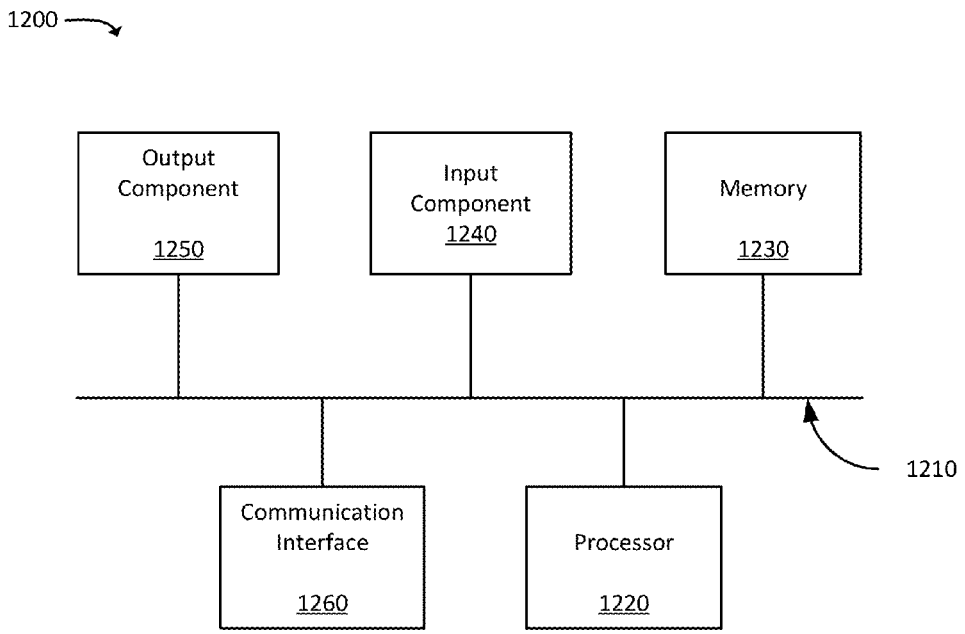
FIG. 12 is a diagram of example components of a computing device.

FIG. 12 is a diagram of example components of a computing device 1200. One or more of the devices described above (e.g., device logic 355, as described with respect to FIG. 3) may include one or more devices 1200. Device 1200 may include bus 1210, processor 1220, memory 1230, input component 1240, output component 1250, and communication interface 1260. In another implementation, device 1200 may include additional, fewer, different, or differently arranged components.

Bus 1210 may include one or more communication paths that permit communication among the components of device 1200. Processor 1220 may include a processor, microprocessor, or processing logic that may include processing circuitry to interpret and execute instructions. Memory 1230 may include any type of dynamic storage device that may store information and instructions for execution by processor 1220, and/or any type of non-volatile storage device that may store information for use by processor 1220.

Input component 1240 may include a mechanism that permits an operator to input information to device 1200, such as a keyboard, a keypad, a button, a switch, etc. Output component 1250 may include a mechanism that outputs information to the operator, such as a display, a speaker, one or more LEDs, etc.

Communication interface 1260 may include any transceiver-like mechanism that enables device 1200 to communicate with other devices and/or systems. For example, communication interface 1260 may include an Ethernet interface, an optical interface, a coaxial interface, or the like. Communication interface 1260 may include a wireless communication device, such as an infrared (IR) receiver, a Bluetooth radio, a Wi-Fi radio, a cellular radio, or the like. The wireless communication device may be coupled to an external device, such as a remote control, a wireless keyboard, a mobile telephone, etc. In some embodiments, device 1200 may include more than one communication interface 1260. For instance, device 1200 may include an optical interface and an Ethernet interface.

Device 1200 may perform certain operations relating to one or more processes described above. Device 1200 may perform these operations in response to processor 1220 executing software instructions stored in a computer-readable medium, such as memory 1230. A computer-readable medium may be defined as a non-transitory memory device. A memory device may include space within a single physical memory device or spread across multiple physical memory devices. The software instructions may be read into memory 1230 from another computer-readable medium or from another device. The software instructions stored in memory 1220 may cause processor 1220 to perform processes described herein. Alternatively, hardwired circuitry may be used in place of or in combination with software instructions to implement processes described herein. Thus, implementations described herein are not limited to any specific combination of hardware circuitry and software.

The foregoing description of implementations provides illustration and description, but is not intended to be exhaustive or to limit the possible implementations to the precise form disclosed. Modifications and variations are possible in light of the above disclosure or may be acquired from practice of the implementations. For example, while a series of blocks have been described with regard to FIG. 11, the order of the blocks may be modified in other implementations. Further, non-dependent blocks may be performed in parallel. In some implementations, additional blocks may be performed before, after, or in between the described blocks.

To the extent the aforementioned embodiments collect, store or employ personal information provided by individuals, it should be understood that such information shall be used in accordance with all applicable laws concerning protection of personal information. Additionally, the collection, storage and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

The actual software code or specialized control hardware used to implement an embodiment is not limiting of the embodiment. Thus, the operation and behavior of the embodiment has been described without reference to the specific software code, it being understood that software and control hardware may be designed based on the description herein.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

Further, while certain connections or devices are shown, in practice, additional, fewer, or different, connections or devices may be used. Furthermore, while various devices and networks are shown separately, in practice, the functionality of multiple devices may be performed by a single device, or the functionality of one device may be performed by multiple devices. Further, multiple ones of the illustrated networks may be included in a single network, or a particular network may include multiple networks. Further, while some devices are shown as communicating with a network, some such devices may be incorporated, in whole or in part, as a part of the network.

No element, act, or instruction used in the present application should be construed as critical or essential unless explicitly described as such. An instance of the use of the term "and," as used herein, does not necessarily preclude the interpretation that the phrase "and/or" was intended in that instance. Similarly, an instance of the use of the term "or," as used herein, does not necessarily preclude the interpretation that the phrase "and/or" was intended in that instance. Also, as used herein, the article "a" is intended to include one or more items, and may be used interchangeably with the phrase "one or more." Where only one item is intended, the terms "one," "single," "only," or similar language is used. Further, the phrase "based on" is intended to mean "based, at least in part, on" unless explicitly stated otherwise.

What is claimed is:

1. An on-board diagnostic (OBD) connector device comprising:

a housing;

a set of upper pins to implement OBD connections with an OBD system of a vehicle, the set of upper pins extruding from the housing and being physically arranged to be compatible with a female OBD connector;

a set of lower pins to implement OBD connections with the OBD system of the vehicle, the set of lower pins extruding from the housing and being physically arranged to be compatible with the female OBD connector;

a middle portion, disposed between the set of upper pins and the set of lower pins, the middle portion including:

a tongue that protrudes from the housing to provide stability for the OBD connector, the tongue extruding from a first section of the middle portion, and including:

a first tongue portion located at one end of the middle portion, and a second tongue portion located at another end of the middle portion; and one or more pins disposed in a second section of the middle portion, the one or more pins extruding from the housing to a height less than a height of the tongue and wherein the one or more pins are disposed between the first tongue portion and the second tongue portion.

2. The OBD connector device of claim 1, wherein the OBD connector device includes a male connector compatible with the female OBD connector.

3. The OBD connector device of claim 1, wherein the set of upper pins and the set of lower pins provide signaling and power connections for an OBD system.

4. The OBD connector device of claim 1, wherein the second section of the middle portion covers approximately one third of the middle portion and the first portion covers approximately two-thirds of the middle portion.

5. The OBD connector device of claim 1, wherein the OBD connector includes an OBD-II compatible connector, and wherein the set of upper pins and the set of lower pins are associated with signals relating to the OBD-II standard, and wherein the one or more pins disposed in the second section of the middle portion are not associated with the OBD-II standard.

6. The OBD device of claim 1, wherein the OBD connector includes an OBD-II compatible connector.

7. An on-board diagnostic (OBD) device comprising:
a male OBD connector including:
a set of upper pins,
a set of lower pins, and
a middle portion, disposed between the set of upper pins and the set of lower pins, the middle portion including one or more pins; and
identification logic including:
a sensor connected to the one or more pins, the sensor to sense, when the OBD device is connected to a compatible adapter, one or more values corresponding to a type of the compatible adapter.

8. The OBD device of claim 7, further comprising:
device logic to communicate, via the male OBD connector, with an OBD system of a vehicle.

9. The OBD device of claim 7, wherein the sensor includes at least one of a resistance sensor, a capacitance sensor, or a frequency sensor, and
wherein the type of the compatible adapter is based on a value of the resistance, capacitance, or frequency, sensed by the sensor.

10. The OBD device of claim 7, wherein the sensor includes a sensor to detect, based on voltages applied to the one or more pins, a binary encoded value, and wherein the type of the compatible adapter is based on a value of the binary encoded value.

11. The OBD device of claim 7, wherein the sensor includes a Hall effect sensor.

12. The OBD device of claim 7, wherein the sensor includes a light sensor, and wherein the type of the compatible adapter is based on a detected intensity or frequency of light sensed by the light sensor.

13. The OBD device of claim 7, wherein the OBD device includes an OBD-II telematics device and the compatible adapter includes a Y-cable.

14. The OBD device of claim 7, wherein the middle portion of the male OBD connector further includes:
a tongue that extends outward to provide stability for an OBD connection, wherein the tongue and the one or more pins together extend over an area approximately equal to an area covered by the first set of upper pins.

15. The OBD device of claim 14, wherein the tongue extends outward to a height greater than or equal to a height of the one or more pins.

16. A method comprising:
detecting, by an on-board diagnostic (OBD) device, insertion of the OBD device into a female OBD connection;
determining, by the OBD device, values associated with one or more pins of the OBD device that are connected via the female OBD connection, the one or more pins including pins dedicated to determining a type of an adapter to which the OBD device is connected; and
identifying, by the OBD device and based on the determined values, the type of the adapter to which the OBD device is connected.

17. The method of claim 16, wherein determining the values associated with the one or more pins includes:
measuring a resistance, a capacitance, or a frequency associated with the one or more pins.

18. The method of claim 16, wherein determining the values associated with the one or more pins includes:
determining, based on voltages applied to the one or more pins, a binary encoded value corresponding to the type of the adapter.

19. The method of claim 16, wherein determining the values associated with the one or more pins includes:
determining, based on voltages applied to the one or more pins, a binary encoded value corresponding to the type of the adapter.

20. The method of claim 16, where in the OBD device includes an OBD-II telematics device, and wherein the one or more pins are not associated with the OBD-II standard.

* * * * *